US008955890B2

(12) United States Patent
Meidinger et al.

(10) Patent No.: US 8,955,890 B2
(45) Date of Patent: Feb. 17, 2015

(54) LOCKABLE VEHICLE CLOSURE BUMPERS

(75) Inventors: Warren J. Meidinger, Lansing, MI (US); Andrew J. Novajovsky, Grand Blanc, MI (US); Andrew G. Fox, Farmington Hills, MI (US); Paul R. Meernik, Redford, MI (US); James H. Shoemaker, White Lake, MI (US); Scott W. Thorpe, Milford, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1421 days.

(21) Appl. No.: 12/627,340

(22) Filed: Nov. 30, 2009

(65) Prior Publication Data

US 2011/0127781 A1 Jun. 2, 2011

(51) Int. Cl.

| | |
|---|---|
| ***E05C 3/06*** | (2006.01) |
| ***E05B 47/00*** | (2006.01) |
| ***E05B 47/02*** | (2006.01) |
| ***E05B 47/06*** | (2006.01) |
| ***E05B 83/24*** | (2014.01) |

(52) U.S. Cl.

CPC ..... *E05B 47/0009* (2013.01); *E05B 47/02* (2013.01); *E05B 47/06* (2013.01); *E05B 83/247* (2013.01)

USPC ..... 292/216; 292/217

(58) Field of Classification Search

USPC ..... 292/216, 217

See application file for complete search history.

(56) References Cited

U.S. PATENT DOCUMENTS

| | | | | |
|---|---|---|---|---|
| 3,400,961 | A * | 9/1968 | Koch et al. | 292/216 |
| 7,258,373 | B2 * | 8/2007 | Plett et al. | 292/210 |

FOREIGN PATENT DOCUMENTS

| | | |
|---|---|---|
| EP | 0982453 A2 | 3/2000 |
| EP | 2159362 A1 | 3/2010 |

* cited by examiner

*Primary Examiner* — Mark Williams

(57) ABSTRACT

A closure assembly and method of operation for a vehicle closure includes a latch for selectively securing the closure to the vehicle, and a lockable bumper assembly that includes an electronic locking mechanism that can selectively secure the bumper in a pocket of the base to add an additional mechanism for securing the closure to the vehicle. The locking mechanism may be controlled to secure the bumper to the base after a controller detects that the latch is latched and the bumper is seated in the pocket of the base.

11 Claims, 5 Drawing Sheets

FIG. 3
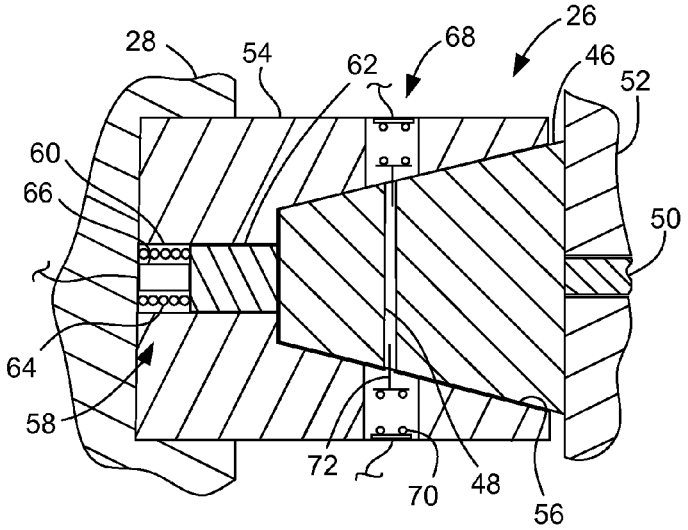
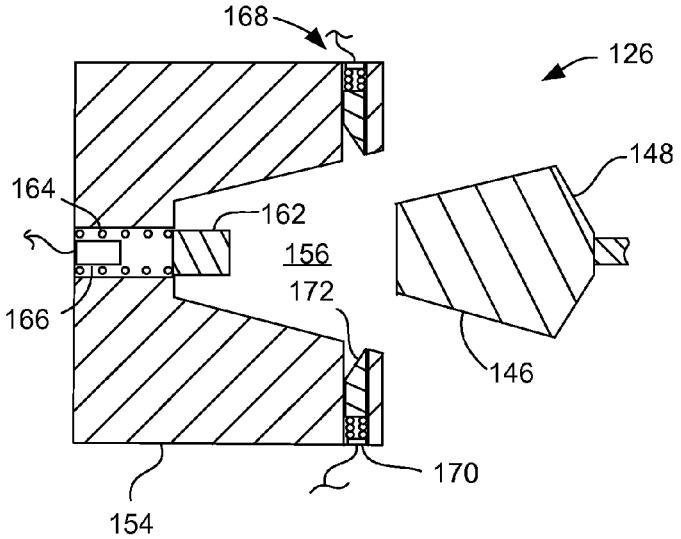
FIG. 4
FIG. 5
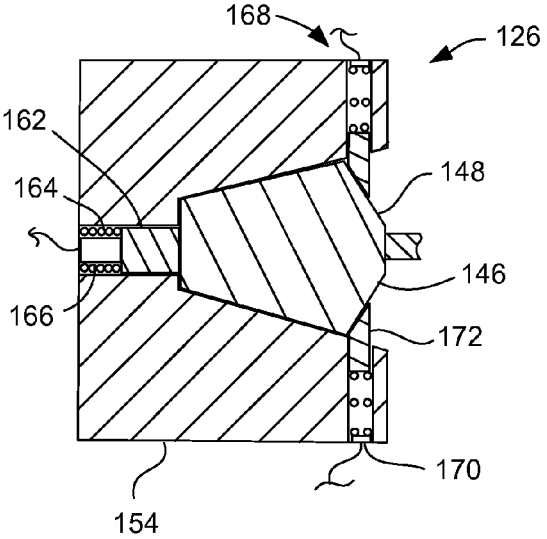

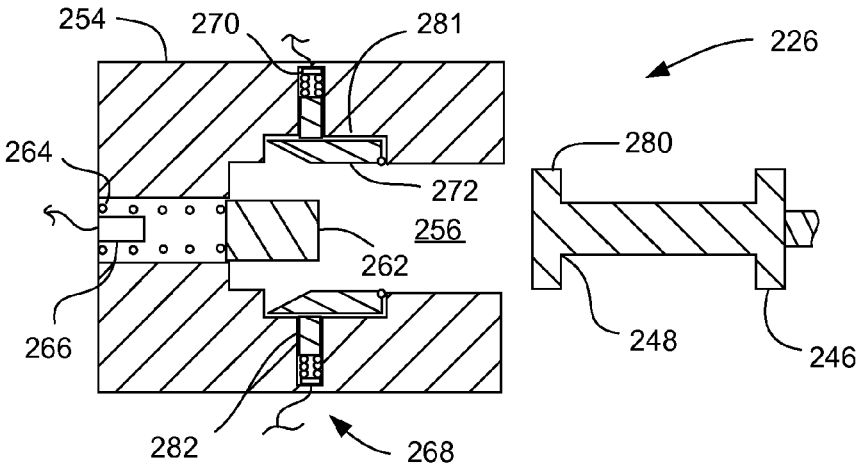
FIG. 6
FIG. 7
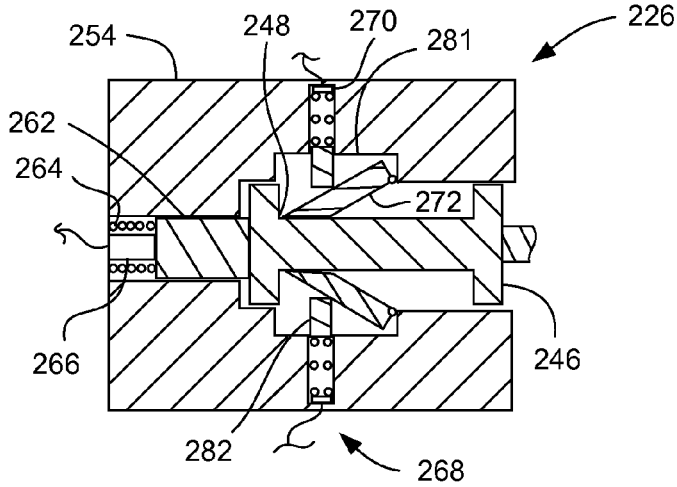
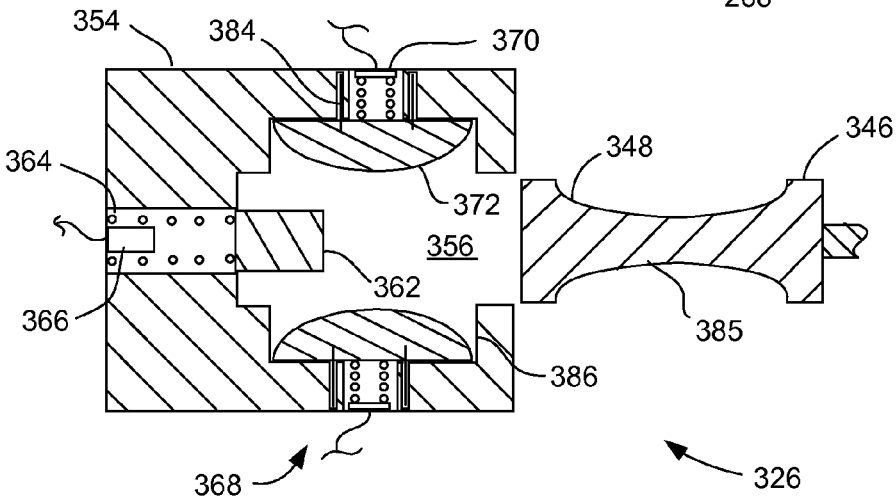
FIG. 8

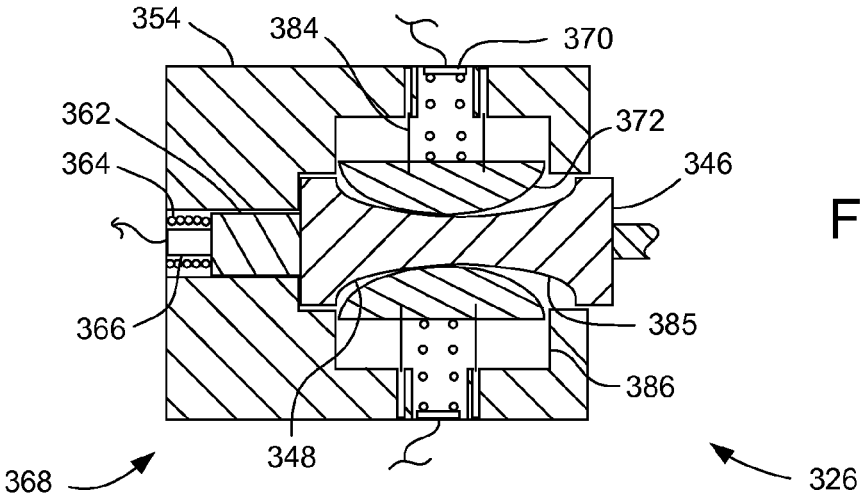
FIG. 9
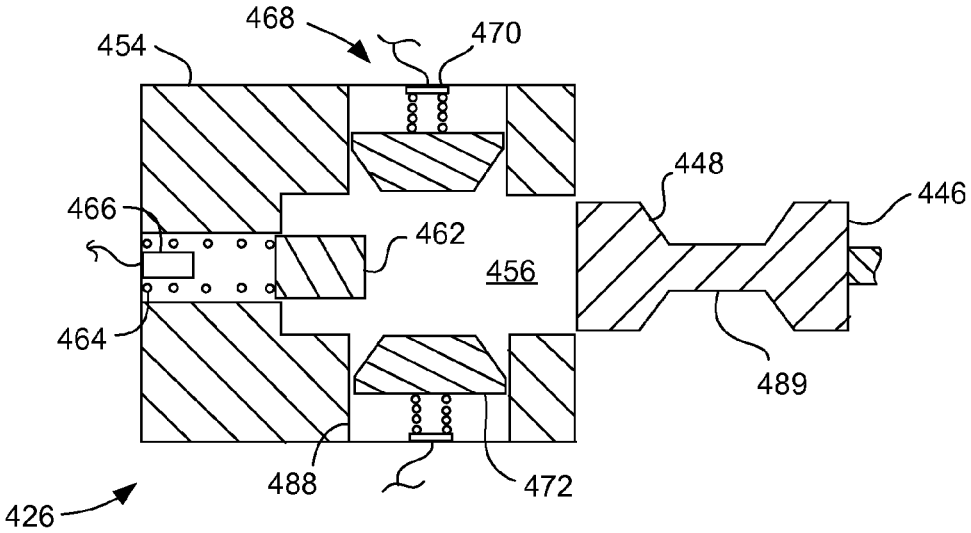
FIG. 10
FIG. 11
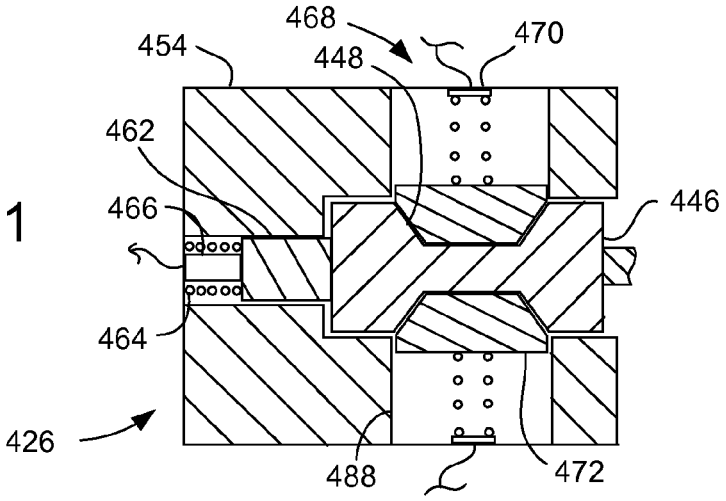

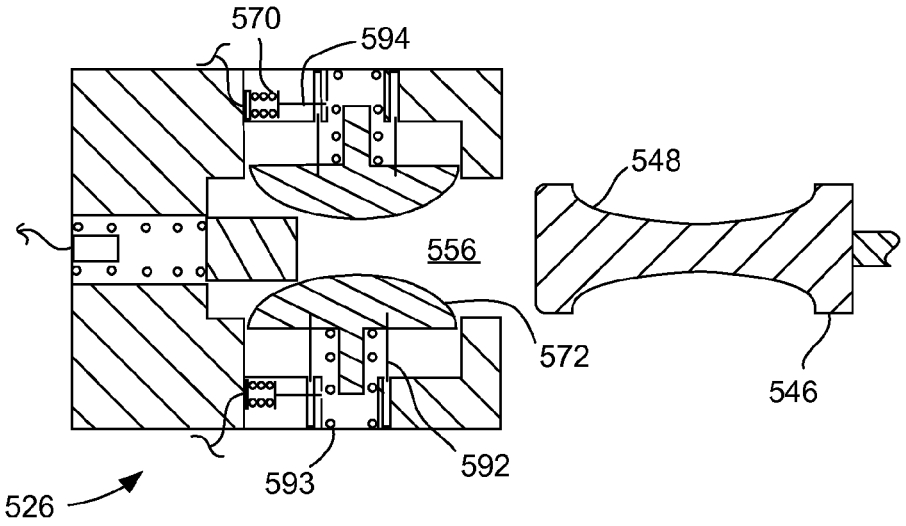
FIG. 12
FIG. 13
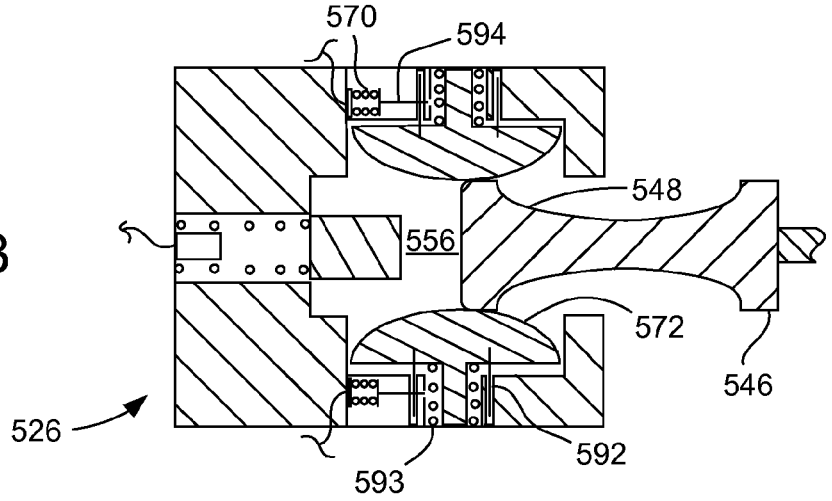
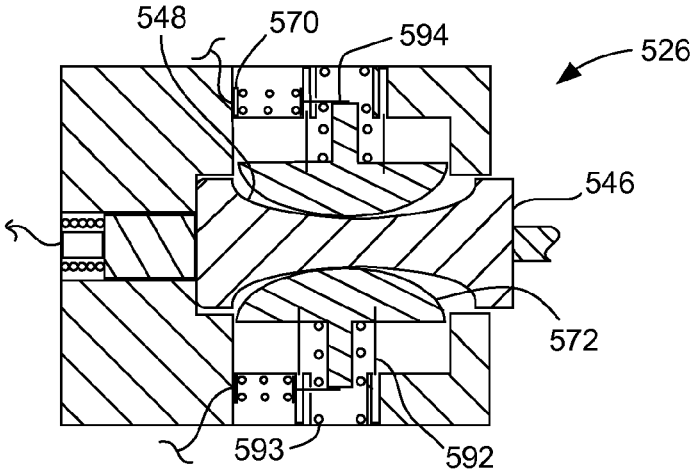
FIG. 14

LOCKABLE VEHICLE CLOSURE BUMPERS

BACKGROUND OF INVENTION

The present invention relates generally to closures used on automotive vehicles and more particularly to bumpers that are used on vehicle closures such as hoods and liftgates.

While operating a vehicle, the vehicle's liftgates may tend to move in their body openings, thus potentially creating undesirable noise and possibly damage to the vehicle. For example, liftgate chucking, which is a rattle condition that occurs during vehicle operation causing hard contact between a latch and striker, may sometimes occur. This situation is typically avoided by using wedge systems with the liftgate. Liftgate wedges are devices that provide additional constraint of the liftgate to improve the stability of the liftgate within the opening. The additional constraint tends to reduce unwanted noise, squeaks and rattles. However, these wedge systems are difficult to align and typically only provide marginal control over the movement of the liftgates in their openings.

In addition, for some vehicles, the corners of the hood may have a tendency to lift at high vehicle speeds due to aerodynamic loads. This condition is sometimes addressed by employing wedges, bumpers or additional latches. However, wedges and bumpers tend to only constrain the hood in one or two directions and are difficult to adjust, where too much contact causes high closing efforts and too little contact substantially reduces their effectiveness.

SUMMARY OF INVENTION

An embodiment contemplates a method for releasably securing a closure on a vehicle to a vehicle body, the method comprising the steps of: moving the closure from an open position to a closed position against the vehicle body; actuating a latch to retain the closure against the vehicle body upon the closure reaching the closed position; inserting a bumper, which is mounted on one of the closure and the vehicle body, into a pocket of a base, which is mounted on the other of the closure and the vehicle body, as the closure approaches the closed position; detecting if the latch is actuated to retain the closure against the vehicle body; detecting if the bumper is fully inserted into the pocket; and actuating an electronic locking mechanism to secure the bumper to the base after detecting that the latch is actuated to retain the closure against the vehicle body and after detecting that the bumper is fully inserted into the pocket.

An embodiment contemplates a method for releasably securing a closure on a vehicle to a vehicle body, the method comprising the steps of: receiving a signal to open the closure when closed; controlling an electronic locking mechanism to release a bumper, which is mounted on one of the closure and the vehicle body, from a pocket of a base, which is mounted on the other of the closure and the vehicle body, wherein the bumper, when in engagement with the base, restrains movement of the closure relative to the vehicle body in three axial directions; releasing a latch, which secures the closure in a closed position, to release the closure from the vehicle body, the latch being released after the electronic locking mechanism releases the bumper; and moving the closure from the closed position to an open position.

An embodiment contemplates a closure assembly that is releasably securable to a vehicle body of a vehicle having a controller. The closure assembly comprises a latch and a lockable bumper. The latch is secured to the closure and releasably engages the vehicle body, with the latch communicating with the controller to indicate a state of the latch being latched or unlatched. The lockable bumper assembly includes a bumper mounted to one of the closure and the vehicle body and a base mounted to the other of the closure and the vehicle body. The base includes a pocket complimentary in shape to the bumper for receiving a portion of the bumper therein, a bumper closed sensor assembly that detects when the bumper is seated in the pocket and communicate this status to the controller, and at least one electronic locking mechanism including a movable retaining flange, with the actuation of the electronic locking mechanism controllable by the controller. The bumper includes a retaining surface that is engageable with the movable retaining flange to selectively secure the bumper in the pocket.

An advantage of an embodiment is that the lockable bumper assembly provides an anti-chucking device for liftgates and a device for resisting hood liftoff at high speeds, while avoiding the difficulties with the alignment of wedges and avoiding the need for additional latches. The lockable bumper assembly provides for three-way constraint, thus significantly reducing movement of the closure relative to the vehicle body while the vehicle is operating. This is accomplished without the need to increase closing efforts for the vehicle closures.

In addition, an advantage of an embodiment is that the lockable bumper assembly provides an additional theft deterrent by preventing the hood or liftgate from being opened when an electronic locking mechanism in the lockable bumper assembly is engaged.

BRIEF DESCRIPTION OF DRAWINGS

FIG. 3 is a schematic section view similar to FIG. 2, but showing the lockable bumper in a closed position.

FIG. 4 is a schematic section view of a lockable bumper in an open position according to a second embodiment.

FIG. 5 is a schematic section view similar to FIG. 4, but showing the lockable bumper in a closed position.

FIG. 6 is a schematic section view of a lockable bumper in an open position according to a third embodiment.

FIG. 7 is a schematic section view similar to FIG. 6, but showing the lockable bumper in a closed position.

FIG. 8 is a schematic section view of a lockable bumper in an open position according to a fourth embodiment.

FIG. 9 is a schematic section view similar to FIG. 8, but showing the lockable bumper in a closed position.

FIG. 10 is a schematic section view of a lockable bumper in an open position according to a fifth embodiment.

FIG. 11 is a schematic section view similar to FIG. 10, but showing the lockable bumper in a closed position.

FIG. 12 is a schematic section view of a lockable bumper in an open position according to a sixth embodiment.

FIG. 13 is a schematic section view similar to FIG. 12, but showing the lockable bumper in a partially closed position.

FIG. 14 is a schematic section view similar to FIG. 12, but showing the lockable bumper in a closed position.

DETAILED DESCRIPTION

Figure 1:
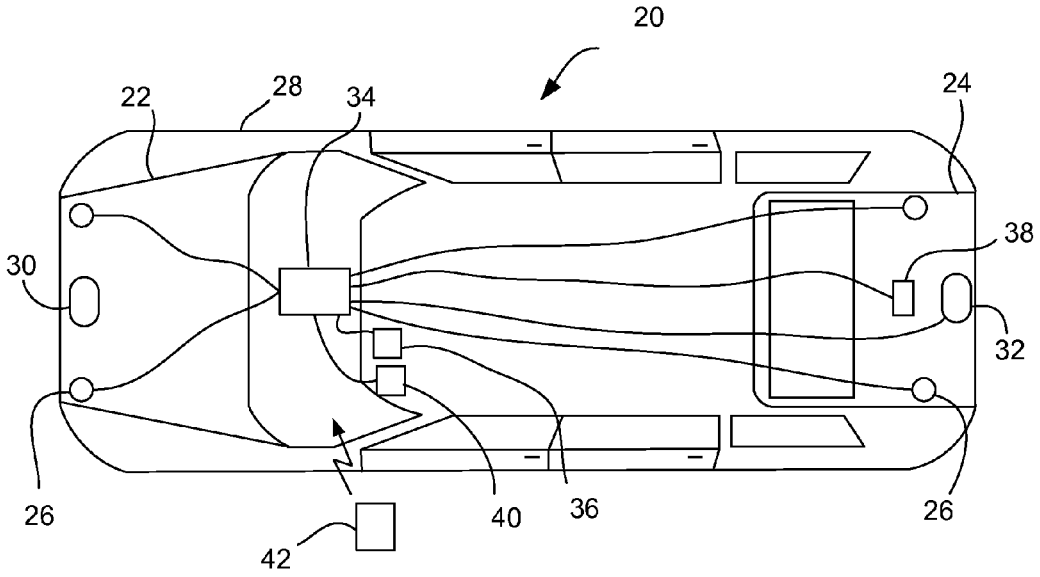
FIG. 1 is a schematic plan view of a vehicle.

FIG. 1 illustrates a vehicle 20 having closures, such as a hood 22 and a liftgate 24, each interacting with a pair of lockable bumper assemblies 26. While a hood 22 and a liftgate 24 are discussed herein, the lockable bumper assemblies 26 may be applied to other vehicle closures as well. Also, there may be only one lockable bumper assembly 26 associated with a particular closure rather than multiple ones, if so desired.

The hood 22 is secured to a front portion of the vehicle body 28 via a hood latch 30, and the liftgate 24 is secured to rear portion of the vehicle body 28 via a liftgate latch 32. A first pair of lockable bumper assemblies 26 mount between the body 28 and the hood 22, while a second pair of lockable bumper assemblies 26 mount between the body 28 and the liftgate 24. The lockable bumper assemblies 26 are not meant to take the place of the latches 30, 32, but are in addition to the latches 30, 32.

A controller 34, which may be a body control module, is located in the vehicle 20 and is in communication with the lockable bumper assemblies 26, the hood latch 30 and the liftgate latch 32. The controller 34 may also be in communication with a liftgate release or liftgate open button 36, a liftgate handle 38, a hood release lever 40 and/or a key fob 42 having buttons relating to release or closure of the liftgate 24 or possibly the hood 22. The controller 34 may be made up of different combinations of electronics hardware and software as is known to those skilled in the art and may be a single controller or multiple separate controllers in communication with one another.

Figure 2:
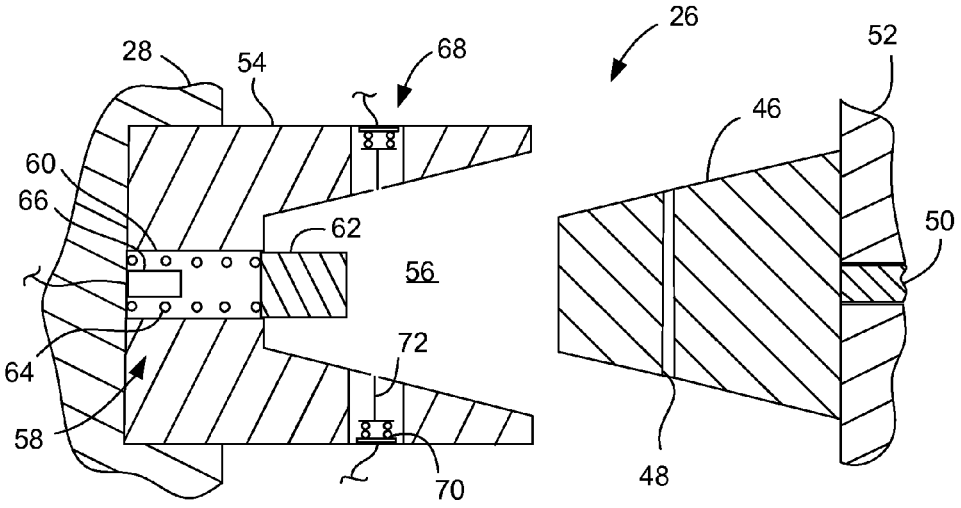
FIG. 2 is a schematic section view of a lockable bumper mounted to vehicle structure in an open position according to a first embodiment.

FIGS. 2 and 3 illustrate a first embodiment of the lockable bumper assembly 26 that may be employed with the vehicle of FIG. 1. The bumper assembly 26 includes a bumper 46, which includes a retaining surface 48 (in this embodiment, a slot) and a mounting member 50, such as, for example, a threaded stud. The mounting member 50 may be mounted to the closure structure 52, which may be part of a hood, liftgate or other vehicle closure structure. The bumper 46 may be a truncated cone shape.

The bumper assembly 26 also includes a base 54 that is mounted to the vehicle body 28. Alternatively, the base 54 may be mounted to the closure structure 52, with the bumper 46 mounted to the vehicle body 28. The base includes a pocket 56 that is complimentary in shape to the bumper 46 and allows the bumper 46 to be received and nest therein.

The base 54 also includes a bumper-closed sensor assembly 58 that is configured to detect when the bumper 46 is seated in the pocket 56. This sensor assembly 58 may include a channel 60 through which a plunger 62 can telescopically slide. A plunger spring 64 may be mounted in the channel 60 and bias the plunger 62 into the pocket 56. The plunger 62, channel 60 and plunger spring 64 cooperate to retain the plunger 62 in the channel 60. A bumper engagement switch 66 may be mounted in the channel 60, opposite the pocket 56, and positioned to be actuated when the plunger 62 is pushed into the channel 60 by the bumper 46.

The base 54 also includes at least one electronic locking mechanism 68 that includes an electronically actuatable, moving mechanism 70 that controls the movement of a movable retaining flange 72. The moving mechanism 70 can move the retaining flange 72 into and out of contact with the retaining surface 48 on the bumper 46 when the bumper 46 is received in the pocket 56. The moving mechanism 70 is preferably configured so that the retaining flange 72 extends into the pocket 56 when no electric current is applied to the electronic locking mechanism 68 and is retracted from the pocket when an electric current is applied to the electronic locking mechanism 68. The bumper engagement switch 66 and the electronic locking mechanism 68 may be in communication with the controller 34 (shown in FIG. 1).

The moving mechanism 70 may be made of, for example, a shape memory alloy that changes shape as heat is applied, resulting in motion, and that returns to the original shape after the heat is removed. The heat applied may be from an electric current that is activated and deactivated by the controller 34. Alternatively, other types of electronically actuatable, moving mechanisms may be employed instead, if so desired.

The operation of the lockable bumper assembly 26 will be described with reference to FIGS. 1-3. When the closure (such as a hood 22 or liftgate 24) is partially or fully open, the bumper 46 is located outside of the pocket 56 (see position in FIG. 2). Thus, the bumper 46 does not push down on the plunger 62, resulting in the bumper engagement switch 66 indicating an open position. While the bumper engagement switch 66 indicates an open position, the controller 34 assures that power is provided to the electronic locking mechanisms 68, thus keeping the movable retaining flanges 72 in retracted positions.

As the closure structure (such as a hood 22 or liftgate 24) is moved to the closed position, the bumper 46 moves into the pocket 56. The movement of the closure may be manual or may be an automated closing process that is activated by the key fob 42 or a button on the vehicle 20. The truncated conical shape of the bumper 46 allows for a small amount of misalignment of the bumper 46 relative to the pocket 56, with the sides of the pocket 56 guiding the bumper 46. As the closure structure reaches the fully closed position (see position in FIG. 3), the bumper 46 pushes the plunger 62 against the bias of the plunger spring 64 and into contact with the bumper engagement switch 66, which signals the controller 34 that the bumper 46 is seated in the base 54. At this point, with the closure in a fully closed position, the latch (a hood latch 30 or a liftgate latch 32, as the case may be) will be engaged, with the controller 34 receiving a signal that the latch is engaged.

With the latch engaged, a signal is sent from the controller 34 to the electronic locking mechanism 68, causing the power to the locking mechanism 68 to be shut off. This causes the moving mechanism 70 to push the movable retaining flanges 72 into engagement with the retaining surface 48 of the bumper 46. The bumper 46 is now secured to the base 54 in the fore-aft, cross-vehicle and vertical directions. The bumpers 46, then, act as anti-chucking devices and a theft deterrent.

Alternatively, when the controller 34 receives a signal that the latch is engaged, the controller may wait until the vehicle speed reaches about five kilometers per hour, for example, and then send a signal that causes the moving mechanism 70 to push the movable retaining flanges 72 into engagement with the retaining surface 48 of the bumper 46.

For opening of a closed hood 22 or liftgate 24, upon a vehicle operator actuating the liftgate handle 38, using a key fob 42 to signal the vehicle 20 to open the liftgate, actuating a liftgate release button 36 or actuating a hood release lever 40, the controller 34 will cause the electronic locking mechanisms 68 to retract the movable retaining flanges 72. This allows the hood 22 or liftgate 24, as the case may be, to open once the particular latch 30 or 32 has been released.

FIGS. 4 and 5 illustrate a second embodiment of the lockable bumper assembly 126 that may be employed with the vehicle of FIG. 1. The arrangement in FIGS. 4 and 5 have many items in common with that of FIGS. 2 and 3 and to avoid unnecessary repetition of the description, the same reference numbers have been used but falling within the 100-series. The significant difference between this embodiment and the first embodiment is the way that the electronic locking mechanisms 168 engage the bumper 146. The electronically actuatable, moving mechanisms 170 engage movable retaining flanges 172 that are wedge-shaped and engage with a retaining surface 148 on the back side of the bumper 146.

The lockable bumper assembly 126 essentially works the same as in the first embodiment. The bumper 146 pushes the plunger 162 against the bias of the plunger spring 164 into contact with the bumper engagement switch 166 as the bumper 146 becomes fully seated in the pocket 156 of the base 154. When appropriate, the controller causes the moving mechanism 170 of the electronic locking mechanism 168 to push the retaining flanges 172 into engagement with the retaining surface 148, locking the bumper 146 in place.

FIGS. 6 and 7 illustrate a third embodiment of the lockable bumper assembly 226 that may be employed with the vehicle of FIG. 1. The arrangement in FIGS. 6 and 7 have many items in common with that of FIGS. 2 and 3 and to avoid unnecessary repetition of the description, the same reference numbers have been used but falling within the 200-series. The significant difference between this embodiment and the first embodiment is the way that the electronic locking mechanisms 268 engage the bumper 246, and the shape of the bumper 246. The electronically actuatable, moving mechanisms 270 engage pivotable retaining flanges 272 via small plungers 282. The retaining flanges 272 are wedge-shaped at one end and engage with a retaining surface 248 on a cross member 280 of an I-shaped bumper 246 when pivoted into the pocket 256. The I-shaped bumper 246 is shaped to slide into the pocket 256 of the base 254 without contacting the retaining flanges 272 while they are recessed into cavities 281 in the base 254.

The lockable bumper assembly 226 essentially works the same as in the first embodiment. The bumper 246 pushes the plunger 262 against the bias of the plunger spring 264 into contact with the bumper engagement switch 266 as the bumper 246 becomes fully seated in the pocket 256 of the base 254. When appropriate, the controller causes the moving mechanism 270 of the electronic locking mechanism 268 to push on the retaining flanges 272, thus pivoting them into engagement with the retaining surface 248 and locking the bumper 246 in place.

FIGS. 8 and 9 illustrate a fourth embodiment of the lockable bumper assembly 326 that may be employed with the vehicle of FIG. 1. The arrangement in FIGS. 8 and 9 have many items in common with that of FIGS. 2 and 3 and to avoid unnecessary repetition of the description, the same reference numbers have been used but falling within the 300-series. The significant difference between this embodiment and the first embodiment is the way that the electronic locking mechanisms 368 engage the bumper 346, and the shape of the bumper 346. The electronically actuatable, moving mechanisms 370 engage movable retaining flanges 372, which are telescopically slidable along the path of guides 384. The retaining flanges 372 have mushroom-shaped cross sections and engage with a retaining surface 348 on a concave curved portion 385 of a bumper 346, having a somewhat I-shaped cross section, when slid into the pocket 356. The bumper 346 is shaped to slide into the pocket 356 of the base 354 without contacting the retaining flanges 372, which are recessed into cavities 386 in the base 354.

The lockable bumper assembly 326 essentially works the same as in the first embodiment. The bumper 346 pushes the plunger 362 against the bias of the plunger spring 364 into contact with the bumper engagement switch 366 as the bumper 346 becomes fully seated in the pocket 356 of the base 354. When appropriate, the controller causes the moving mechanism 370 of the electronic locking mechanism 368 to push on the retaining flanges 372, thus sliding them into engagement with the retaining surface 348 and locking the bumper 346 in place.

FIGS. 10 and 11 illustrate a fifth embodiment of the lockable bumper assembly 426 that may be employed with the vehicle of FIG. 1. The arrangement in FIGS. 10 and 11 have many items in common with that of FIGS. 2 and 3 and to avoid unnecessary repetition of the description, the same reference numbers have been used but falling within the 400-series. The significant difference between this embodiment and the first embodiment is the way that the electronic locking mechanisms 468 engage the bumper 446, and the shape of the bumper 446. The electronically actuatable, moving mechanisms 470 engage movable retaining flanges 472, which are telescopically slidable in cavities 488. The retaining flanges 472 have a truncated triangle-shaped cross section and engage with a retaining surface 448 on a complimentary concave portion 489 of a bumper 446, having a somewhat I-shaped cross section, when slid into the pocket 456. The bumper 446 is shaped to slide into the pocket 456 of the base 454 without contacting the retaining flanges 472, which are recessed into cavities 488 in the base 454.

The lockable bumper assembly 426 essentially works the same as in the first embodiment. The bumper 446 pushes the plunger 462 against the bias of the plunger spring 464 into contact with the bumper engagement switch 466 as the bumper 446 becomes fully seated in the pocket 456 of the base 454. When appropriate, the controller causes the moving mechanism 470 of the electronic locking mechanism 468 to push on the retaining flanges 472, thus sliding them into engagement with the retaining surface 448 and locking the bumper 446 in place.

FIGS. 12-14 illustrate a sixth embodiment of the lockable bumper assembly 526 that may be employed with the vehicle of FIG. 1. The arrangement in FIGS. 12-14 have many items in common with that of FIGS. 8 and 9 and to avoid unnecessary repetition of the description, the same reference numbers have been used but falling within the 500-series. Similar to FIGS. 8 and 9, the movable retaining flanges 572 have mushroom-shaped cross sections and include guides 592 for allowing telescopic movement of the flanges 572. Also, the retaining surfaces 548 of the bumper 546 are concave curved portions. In this embodiment, however, the flanges 572 are biased partially into the pocket 556 by support springs 593. In addition, the electronically actuatable, moving mechanisms 570 are oriented ninety degrees to the direction of orientation in FIGS. 8 and 9. When actuated, the moving mechanisms 570 slide locks 594 behind the retaining flanges 572, preventing them from disengaging with the bumper 546. The other difference with the previous embodiments is that the bumpers 546 must push the retaining flanges 572 out of the way against the bias of the support springs 593 as they slide into and out of the pockets 556.

While certain embodiments of the present invention have been described in detail, those familiar with the art to which this invention relates will recognize various alternative designs and embodiments for practicing the invention as defined by the following claims.

What is claimed is:

1. A method for releasably securing a closure on a vehicle to a vehicle body, the method comprising the steps of:

(a) moving the closure from an open position to a closed position against the vehicle body;

(b) actuating a latch to retain the closure against the vehicle body upon the closure reaching the closed position;

(c) inserting a bumper, which is mounted on one of the closure and the vehicle body, into a pocket of a base, which is mounted on the other of the closure and the vehicle body, as the closure approaches the closed position;

(d) detecting if the latch is actuated to retain the closure against the vehicle body;

(e) detecting if the bumper is fully inserted into the pocket; and (f) actuating an electronic locking mechanism to secure the bumper to the base after detecting that the latch is actuated to retain the closure against the vehicle body and after detecting that the bumper is fully inserted into the pocket.

2. The method of claim 1 wherein step (f) is further defined by actuating the electronic locking mechanism to secure the bumper to the base after detecting that the latch is actuated to retain the closure against the vehicle body, after detecting that the bumper is fully inserted into the pocket, and after the vehicle reaches a predetermined speed.

3. The method of claim 1 wherein step (f) is further defined by actuating the electronic locking mechanism by inducing an electronically actuatable, moving mechanism to move a retaining flange on one of the base and the bumper into engagement with a retaining surface on the other of the base and the bumper to prevent the bumper from pulling out of the pocket.

4. The method of claim 3 wherein step (f) is further defined by the retaining flange being engaged with the retaining surface when no electric current is provided to the moving mechanism and being disengaged from the retaining surface when an electric current is provided to the moving mechanism.

5. The method of claim 1 further including the steps of:

(g) receiving a signal to open the closure when closed;

(h) controlling the electronic locking mechanism to release the bumper from the base; and (i) releasing the latch to release the closure from the vehicle body.

6. The method of claim 5 wherein step (h) further comprises moving a retaining flange on the base out of engagement with a retaining surface on the bumper to allow the bumper to pull out of the pocket in the base.

7. The method of claim 1 wherein step (e) is further defined by causing the bumper to move a plunger into engagement with a bumper engagement switch as the bumper becomes seated in the pocket.

8. A method for releasably securing a closure on a vehicle to a vehicle body, the method comprising the steps of:

(a) receiving a signal to open the closure when closed;

(b) controlling an electronic locking mechanism to release a bumper, which is mounted on one of the closure and the vehicle body, from a pocket of a base, which is mounted on the other of the closure and the vehicle body, wherein the bumper, when in engagement with the base, restrains movement of the closure relative to the vehicle body in three axial directions;

(c) releasing a latch, which secures the closure in a closed position, to release the closure from the vehicle body, the latch being released after the electronic locking mechanism releases the bumper; and (d) moving the closure from the closed position to an open position.

9. The method of claim 8 further including the steps of:

(e) moving the closure from the open position to the closed position against the vehicle body;

(f) actuating the latch to retain the closure against the vehicle body upon the closure reaching the closed position;

(g) inserting the bumper into the pocket of the base as the closure approaches the closed position;

(h) detecting if the latch is actuated to retain the closure against the vehicle body;

(i) detecting if the bumper is fully inserted into the pocket; and (j) actuating the electronic locking mechanism to secure the bumper to the base after detecting that the latch is actuated to retain the closure against the vehicle body and after detecting that the bumper is fully inserted into the pocket.

10. The method of claim 8 wherein step (b) is further defined by controlling the electronic locking mechanism by inducing an electronically actuatable, moving mechanism to move a retaining flange on one of the base and the bumper out of engagement with a retaining surface on the other of the base and the bumper to allow the bumper to pull out of the pocket.

11. The method of claim 10 wherein step (b) is further defined by the retaining flange being engaged with the retaining surface when no electric current is provided to the moving mechanism and being disengaged from the retaining surface when an electric current is provided to the moving mechanism.

* * * * *